United States Patent [19]

Salomon

[11] 4,260,175

[45] Apr. 7, 1981

[54] SAFETY BINDING ADAPTED TO BE MOUNTED ON A SKI

[75] Inventor: Georges P. J. Salomon, Annecy, France

[73] Assignee: Etablissements Francois Salomon and Fils, Annecy, France

[21] Appl. No.: 964,205

[22] Filed: Nov. 28, 1978

[30] Foreign Application Priority Data

Mar. 22, 1978 [FR] France ..... 78 08342

[51] Int. Cl.[3] ..... A63C 9/085

[52] U.S. Cl. ..... 280/629

[58] Field of Search ..... 280/611, 626, 623, 629

[56] References Cited

U.S. PATENT DOCUMENTS 3,595,595 7/1971 Axthammer ..... 280/629

FOREIGN PATENT DOCUMENTS 1964306 7/1971 Fed. Rep. of Germany ..... 280/629

2020954 11/1971 Fed. Rep. of Germany ..... 280/629

94846 10/1969 France ..... 280/629

*Primary Examiner*—John P. Silverstrim

*Assistant Examiner*—Michael Mar

*Attorney, Agent, or Firm*—Haseltine, Lake & Waters

[57] ABSTRACT

A safety binding adapted to be mounted on a ski comprises a one-piece jaw in which engages and is maintained one end of the sole of a ski boot, this jaw being urged under the action of a resilient device against two support lines provided on a rear transverse face of a support member. The support lines, viewed along the axis of the ski, converge towards a point located above the ski. The resilient device comprises a pressure member bearing upon the front transverse face of the support presenting at least two lines of reaction converging towards the ski.

8 Claims, 17 Drawing Figures

SAFETY BINDING ADAPTED TO BE MOUNTED ON A SKI

FIELD OF THE INVENTION

The present invention relates to a safety binding adapted to be mounted on a ski.

BACKGROUND OF THE INVENTION

Safety binding, called front abutments, are known which comprise a one piece jaw in which engages and is maintained the front part of the sole of a ski boot. This jaw is maintained in contact against two lateral support lines disposed on a support member respectively on each side of the longitudinal axis of the ski and the jaw is urged towards the front of the ski under the action of a resilient member. As a result the jaw can pivot on one or the other of the support lines when the foot of a skier is subjected to a torsional force in one direction or the other to insure release.

In this known safety binding, the two support lines are vertical, that is to say perpendicular to the upper surface of the ski. Such an arrangement has the disadvantage that, in certain instances of release of the safety binding, an increase in the release force is caused. This especially occurs during the course of a lateral release.

Indeed, as the sole engages under the edge of the jaw or the sole clip and the point of support is at the same horizontal level, there results a significant chafing of the sole under the edge, which chafing produces a resisting force opposing movement with a resulting increase in the release force. Due to this, good functioning of the security binding is prevented.

SUMMARY OF THE INVENTION

The present invention has for an object the improving of the operation of the binding during a lateral release thanks to a specific embodiment of the support member upon which acts the resilient member.

According to the invention the safety binding for a ski having a longitudinal plane of symmetry comprises a one-piece jaw having a rear end in which can be engaged and maintained one end of the sole of a ski boot, a casing integrally extending from said jaw frontwardly, support means connectible to said ski and providing two lateral support lines disposed respectively on either side of the longitudinal plane of symmetry of the ski, said jaw and casing defining a bore, said jaw having a front transverse face, said support means comprising a support member engaged in said bore and having a front transverse face and a rear transverse face opposed to the front transverse face of the jaw, one of the front transverse face of the jaw and the rear transverse face of the support member including projections and the other transverse face having recesses receiving said projections and defining said support lines while permitting relative movement between said jaw and said support member, and resilient means located in said bore and acting on the front transverse face of the support member and on said jaw to urge said projections into said recesses such that the jaw can pivot on either line of support. The lines of support viewed along the longitudinal axis of the ski converges towards a point disposed above the ski in order that in one direction of lateral movement of the jaw, the jaw will pivot about one line of support and in the other direction of lateral movement of the jaw, the jaw will pivot about the other line of support. The resilient means comprise a pressure member bearing upon the front transverse face of the support member and a spring engaging said pressure member and said casing. The support member comprises, on its front transverse face, at least two lines of reaction converging towards the ski and such that, in a position of the jaw distant from the central position, the line of support of said jaw and casing and the line of reaction whereon said pressure member is pressed are respectively located on either side of the longitudinal plane of symmetry of the ski.

BRIEF DESCRIPTION OF DRAWINGS

Embodiments of the present invention will now be described by way of example, with reference to the accompanying drawings, in which.

DESCRIPTION OF PREFERRED EMBODIMENTS

Figure 1:
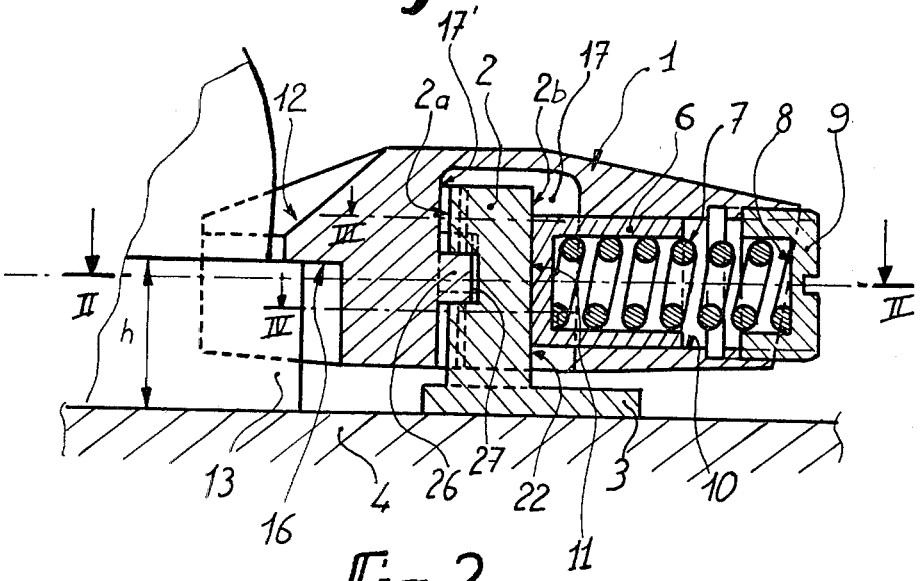
FIG. 1 is a view in vertical axial section of an embodiment of a safety binding according to the invention.

With reference to FIGS. 1 to 9, an embodiment of the safety binding according to the invention will now be described, which constitutes an abutment for the front of a ski boot 13. It comprises a body or casing 1 which is movably mounted on a fixed part 2 forming support on which it is held elastically in abutment. This support means 2 is fast with a base plate 3 which is fixed on the upper surface of a ski 4, for example by means of screws 5. The body 1 is held elastically in abutment on the fixed support 2 due to an elastic device comprising a piston 6 urged by a compression spring 7 which is permanently applied under pressure by this spring against the front face 2*b* of the support means 2. The compression spring 7 which extends axially inside the body 1 abuts, moreover, at its front end, on the bottom 8 of an adjusting plug 9 screwed at the front of the body. The piston 6 is mounted to slide in a bore 10 disposed in the front part of the body 1, along the longitudinal axis thereof.

The piston 6 is preferably constituted by a cylindrical sleeve of revolution comprising a rear support face 11 which is applied against the front face 2b of the support means 2.

A jaw 12 which is fast with the body 1 and in fact constitutes the rear part of said latter, maintains the front of the ski boot 13. The boot is maintained laterally due to the substantially vertical faces 14 and 15 of the wings of the jaw 12 and vertically due to a horizontal flange 16 of this jaw.

Figure 2:
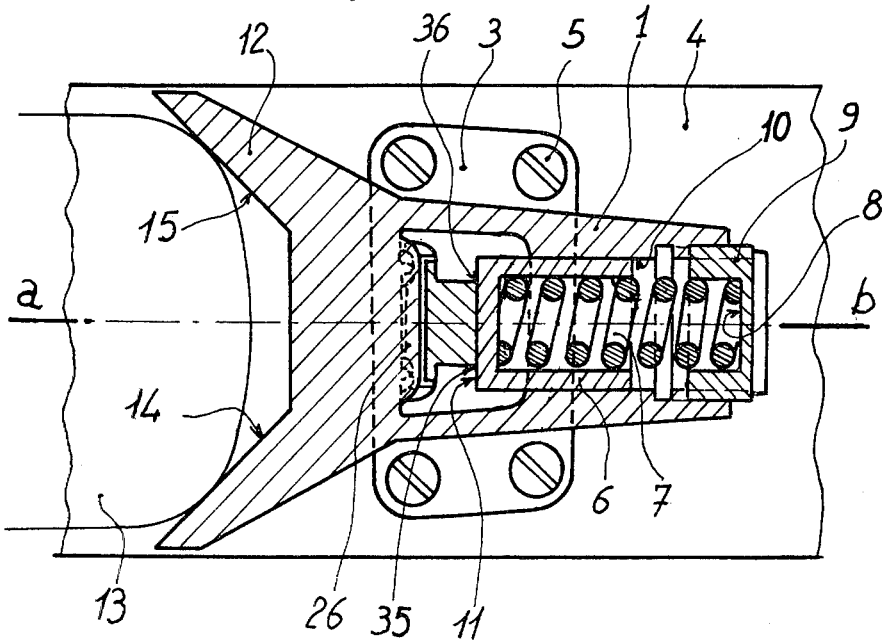
FIG. 2 is a horizontal sectional view on line II—II of FIG. 1.

As may be seen in FIGS. 1 and 2, the body 1 comprises a central recess 17 in which is engaged the support means 2. This recess 17 is substantially parallelpipedic in form and it is open downwardly, i.e. in the direction of the ski 4. The dimensions of this recess are such that the pivoting of the body 1 is possible on the two sides, as may be seen in particular in FIG. 6.

Figure 3:
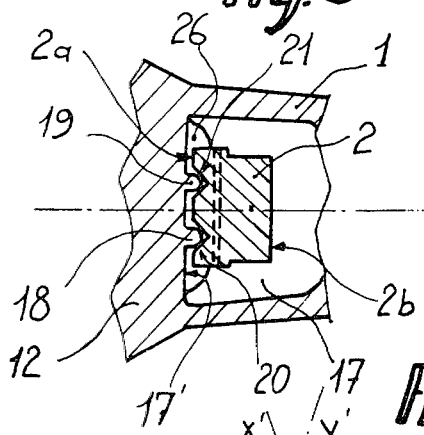
FIG. 3 is a partial horizontal sectional view one line III—III of FIGS. 1 and 5, the piston not being shown.
Figure 4:
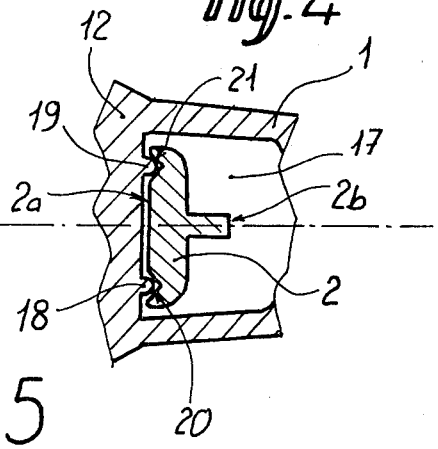
FIG. 4 is a partial horizontal sectional view on line IV—IV of FIGS. 1 and 5, the piston not being shown.
Figure 5:
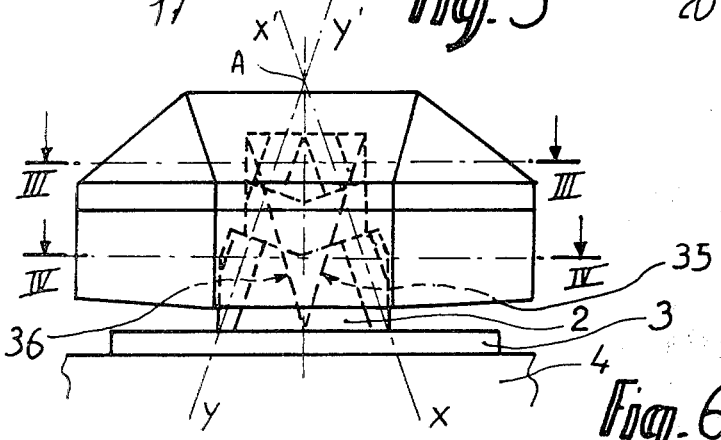
FIG. 5 is a view in elevation of the binding of FIGS. 1 to 4 along the longitudinal axis of the ski.
Figure 7:
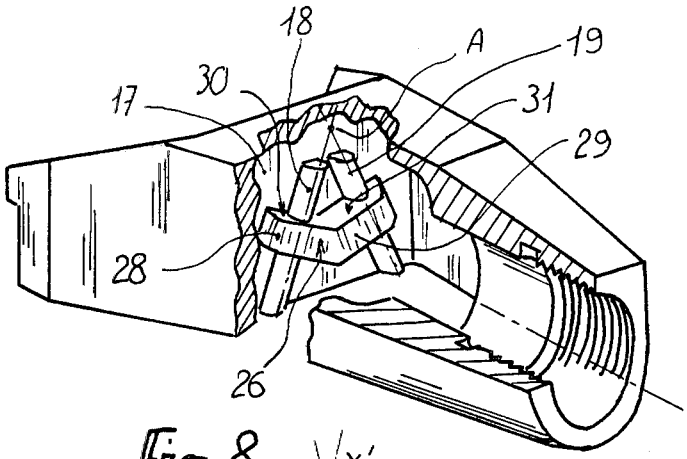
FIG. 7 is a perspective view, with parts torn away, of the one-piece jaw-casing assembly.
Figure 9:
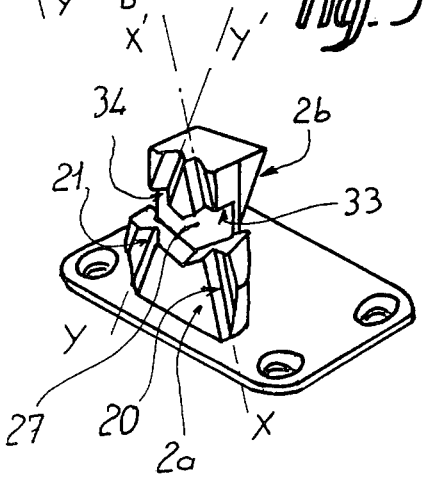
FIG. 9 is a perspective view showing the rear face of the fixed support means.

The inner and rear face 17' of the recess 17, i.e. the one located on the jaw 12 side, presents two forwardly projecting sections 18 and 19 (FIGS. 3, 4 and 7). These two projecting sections constitute two ribs which advantageously converge at a point A (FIGS. 5 and 7) above the ski.

When the body 1 is in normal position of use or in rest position, the two ribs (projecting sections) 18 and 19 take their place in two corresponding grooves or hollow sections 20 and 21 provided in the rear face 2a of the support means 2 and which converge at point A located above the ski.

The two ribs 18 and 19 thus engaged in the two grooves 20 and 21 thus define two support lines X—X' and Y—Y' converging at point A.

The ribs 18 and 19 may present rounded cross-sections, indicated by 18' and 19' in FIG. 3 the grooves 20 and 21 having for example a V-shaped cross section.

A sufficient space e is provided between the rear face 17' of the recess 17 and the rear face 2a of the support means 2, to allow the pivoting movement of the ribs 18, 19.

The holding of the body 1 in abutment on the rear face 2a of the support means 2 is effected due to the elastic device which is disposed towards the front with respect to the fixed support means 2 and which comprises the piston 6 urged rearwardly by the spring 7. This piston 6 is thus permanently in elastic abutment against the front face 2b of the support means 2.

This front face 2b is preferably flat and included in a plane parallel to the plane defined by the support lines X—X' and Y—Y'. This front face has the form of an isosceles triangle with downwardly directed vertex (FIG. 8), and the apices of which are indicated by 23, 24, 25. According to the invention, the edge 35 which is between the upper apex 24 and the lower apex 23 of the triangular front face 2b is parallel to the support line Y—Y', whilst the other edge 36 between the other upper apex 25 and the lower apex 23 is parallel to support line X—X'.

It should be noted that the support line X—X' and the edge 36 are on either side of the longitudinal plane of symmetry a-b perpendicular to the ski and that the same applies to the other support line Y—Y' and the edge 35.

The vertical retention of the body 1 with respect to the fixed support means 2 is effected by means of a boss 26 (FIGS. 1, 2, 3, 6, 7) which extends forwardly from the rear face 17' of the recess 17 and which is engaged in a corresponding housing 27 made in the rear face 2a of the support means 2.

As may be seen in FIG. 7 the boss 26 in fact comprises two projecting sections 28 and 29 corresponding respectively to the ribs 18 and 19. These projecting sections extend substantially perpendicularly to the axis of the ribs 18 and 19, i.e. to the support lines X—X' and Y—Y', so that the boss 26 has, as a whole, the shape of a V which is very widely open upwardly.

The projections 28 and 29 respectively define upper retaining flanges 30 and 31 (FIG. 7). These flanges 30 and 31 are in planes respectively perpendicular to the axis of ribs 18 and 19.

The hollow section 27 made in the rear face 2a of the support means 2 and with which the boss 26 cooperates, defines two upper flanges 33 and 34 for vertical retention, the upper flange 33 being perpendicular to the support line X—X' and the flange 34 being perpendicular to the other support line Y—Y'.

Figure 6:
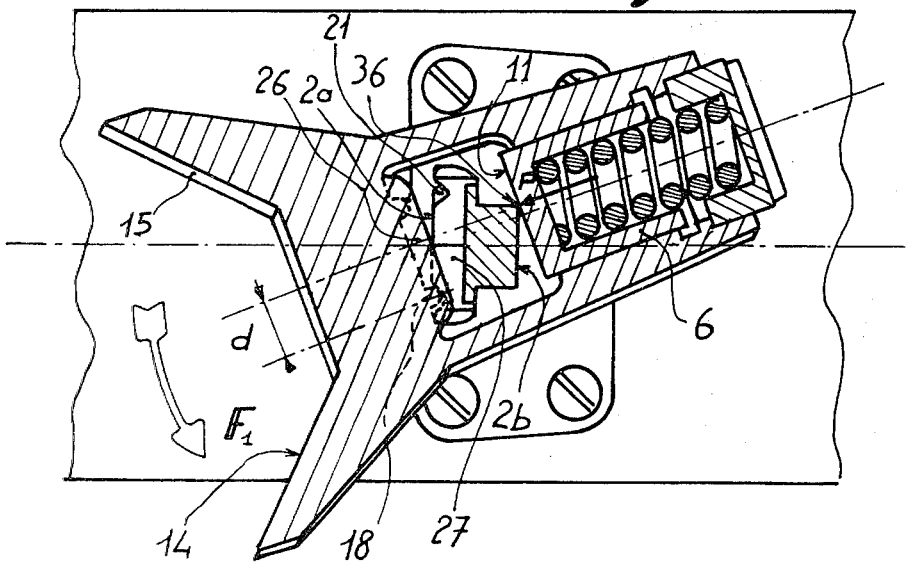
FIG. 6 is a horizontal sectional view similar to that of FIG. 2, the binding being in the course of lateral release.

Upon lateral release, the jaw 12 and casing or body 1 assembly pivots either on one of the support lines X—X' or on the other, Y—Y', depending on the direction of release. This pivoting is effected elastically against the action of the elastic device acting by action of the piston 6 against the front face 2b of the support means 2, along a line of reaction. FIG. 6 illustrates a lateral release to the right, in the direction of arrow $F_1$.

It is seen that, for such a release, the jaw pivots on the support line X—X' materialised by the rib 18 housed in the groove 20. The other rib 19 is then separated from the corresponding groove 21. It is seen that, in the case of such a pivoting, the rear face 11 of the piston 6 is in contact with the edge 36 of the front face 2b of the fixed support means 2.

The force exerted by the compression spring being P, the torque resisting the release is a function of Px d, d being the distance of application of the force P (FIG. 6).

It should be noted that, upon a lateral pivoting, the jaw has a somewhat particular movement due to the inclination of the support line X—X' or Y—Y', thus of the axis of pivoting.

The adjustment in height allowing the adaptation of the abutment to the different thicknesses of sole h (FIG. 1) may be effected by means of different devices which, being well known per se, will not be described in detail. This adjustment may be made for example by means of an adjusting screw displacing either the jaw 12 or a part of the jaw with respect to the body or casing 1, or the one-piece casing 1 and jaw 12 assembly with respect to the part of the casing bearing the ribs 18, 19 and the boss 26, or the assembly of the casing with the support means 2 with respect to the base plate 3.

Figure 11:
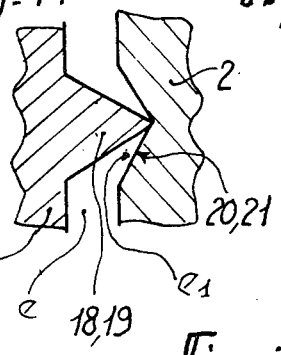
Figure 12:
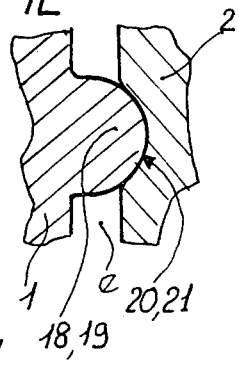

FIGS. 11 and 12 show other embodiments of the support lines. In FIG. 11, the ribs 18 and 19 each have a V-shaped cross-section, whilst the corresponding grooves 20, 21 also have a V-shaped cross-section more open than the preceding, spaces e and $e_1$ being provided to allow the pivoting of the body or casing 1 in the two directions with respect to the support means 2.

In the variant embodiment illustrated in FIG. 12, the ribs 18, 19 and the respective grooves 20, 21 all have a circular cross-section and, there again, a space e is provided to allow the pivoting of the casing 1 with respect to the support means 2.

Figure 13:
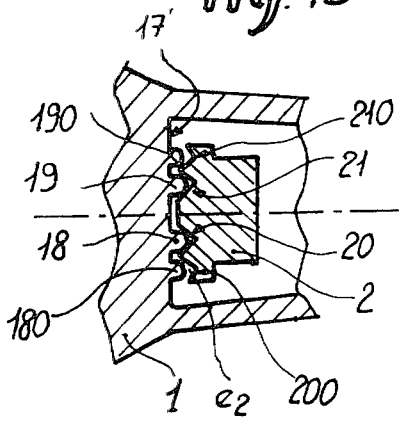
FIG. 13 and 14 are partial horizontal sectional views of another variant embodiment of the mode of support, FIG. 13 being a view in rest position and FIG. 14 being a view in position of lateral release of the binding.
Figure 14:
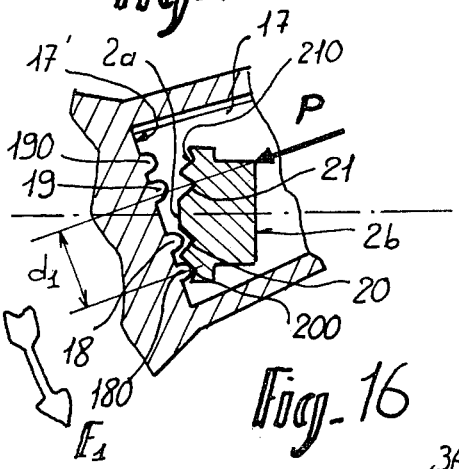
Figure 15:
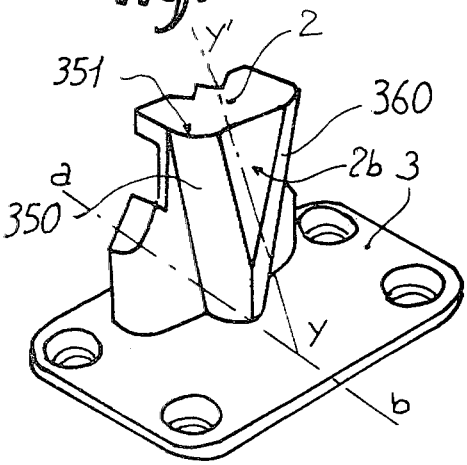
FIG. 15 is a view in perspective of a variant embodiment of the fixed support means.
Figure 16:
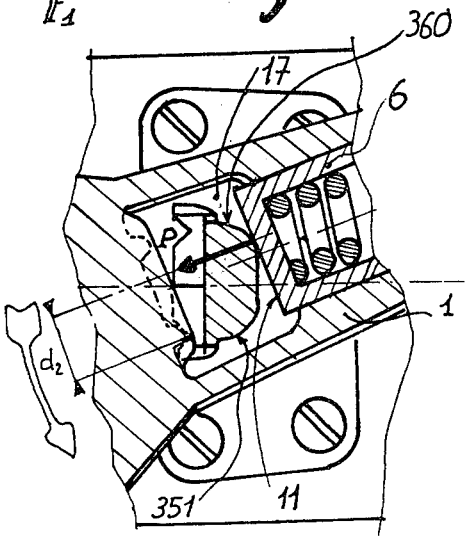
FIG. 16 is a partial horizontal sectional view of a binding comprising a fixed support means as illustrated in FIG. 15, in the course of lateral release.

FIGS. 13 and 14 show variant embodiments of the support lines, whilst FIGS. 15 and 16 illustrate variant embodiments of the lines of reaction.

These variants allow certain variations of the resistant torque by modification, during release, of the lever arm d (FIG. 6) on which is applied the force P of the compression spring 7, and/or by modification of this force P.

In the variant embodiment illustrated in FIGS. 13 and 14, the body or casing 1 of the binding comprises, in addition to ribs 18 and 19, two other ribs, namely a rib 180 parallel to the rib 18 and a rib 190 parallel to rib 19. The two additional ribs 180, 190 are disposed outwardly with respect to the first ribs 18, 19. In the same way, the fixed support means 2 comprises, in addition to the two grooves 20 and 21, two additional grooves located outwardly with respect to the preceding ones, namely a groove 200 parallel to groove 20 and a groove 210 parallel to groove 21.

In the rest position illustrated in FIG. 13, the body 1 is maintained in abutment on the rear face 2*a* of the fixed support means along the two support lines materialised on the one hand by the rib 18 engaged in the groove 20 and on the other hand by the rib 19 engaged in the groove 21. It will be noted that a space $e_2$ is, in this position, arranged between each of the lateral complementary ribs 180, 190, and the bottom of the associated additional groove 200, 210 to allow, in a first stage, the pivoting about one of the two support lines mentioned. With such an arrangement the lateral release is effected in two stages (FIG. 14). The first stage of release is effected by pivoting or by abutment, for example, of the rib 18 in the groove 20, as in the case of FIG. 6, and the second stage is effected by pivoting of the complementary rib 180 in the corresponding groove 200, the preceding rib 18 then separating from its groove 20. Thus, during this second phase of the release, the resistant torque is a function of Px $d_1$, $d_1$ being the distance between the axis along which the force P of the compression spring 7 is applied and the support line between the complementary rib 180 and the corresponding groove 200.

FIGS. 15 and 16 illustrate a variant embodiment of the front face 2*b* of the support means 2.

In the embodiments described previously, the edges 35 and 36 of the support means 2 are fixed with respect thereto, but they constitute, with respect to the piston, lines of reaction which move with respect to the rear face 11 of the latter in the course of a release.

In the variant embodiment illustrated in FIGS. 15 and 16, the lines of reaction in the course of a release move on the fixed means 2. To this end, this fixed piece presents, on its front face 2*b*, two reaction surfaces 350 and 360, symmetrical to each other with respect to the longitudinal plane of symmetry a-b perpendicular to the ski.

The reaction surface 350 is a curved surface which is produced by a line of reaction which moves on a curve, for example the curve 351, whilst remaining parallel to the support line Y—Y'. With such an arrangement, in the course of a release, the rear face 11 of the piston 6 is in abutment on the fixed means 2 along a line of reaction which moves on the front face of this means, whilst always remaining parallel to the support line Y—Y'. The distance $d_2$ between the direction of application of the force P of the compression spring 7 and the support line constituting the axis of pivoting varies in the course of release, this differing from what happens in the case of FIG. 6 where the distance d remains constant.

The reaction surfaces 350 and 360 may be such that there is, or is not, a relative displacement of the instantaneous line of reaction with respect to the piston 6.

It should be noted that the arrangement illustrated in FIGS. 13 and 14 and that of FIGS. 15 and 16 may be used simultaneously.

Figure 8:
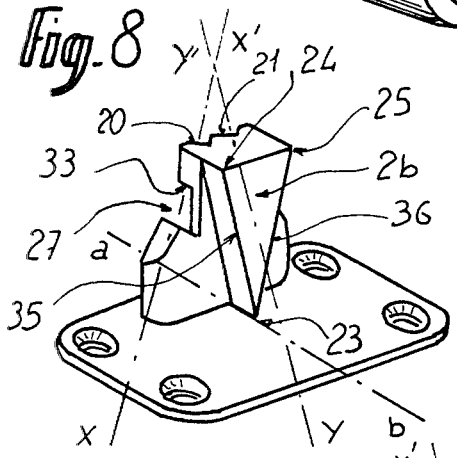
FIG. 8 is a perspective view showing the front face of the support means.
Figure 8A:
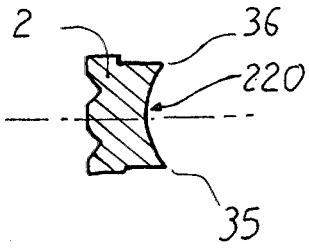
FIG. 8*a* is a partial horizontal sectional view, i.e. along a plane parallel to the ski, of the fixed support means, showing a variant of the front face thereof.
Figure 10:
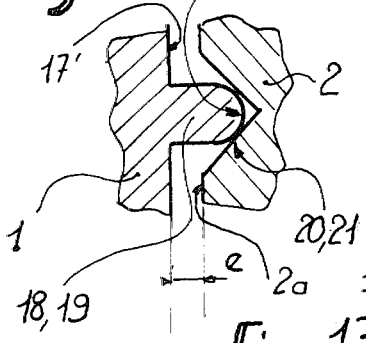
FIGS. 10, 11 and 12 are partial horizontal sectional views, on a larger scale, of three variant embodiments of the mode of support of the one-piece jaw-casing assembly on the fixed support means.

It should also be noted that the front face of the support means 2 could present a central hollow part, 220 so that, in rest position, the piston 6 is really applied only on the two convergent edges 35 and 36 constituting the lines of reaction (FIG. 8*a*).

It is obvious that the various embodiments of the invention which have been given hereinabove, with reference to the accompanying drawings, have been given solely by way of indicative and non-limiting example and that numerous modifications may be made without departing from the scope of the invention. In particular, the ribs and grooves in which these ribs engage could be inversed, the support means then presenting said ribs and the grooves being provided in the one-piece jaw and casing assembly. The same may also apply for the vertical retention sections.

Furthermore, the piston 6 pressed elastically against the front face 2*b* of the support means 2 could be replaced by any other elastically urged member, for example by a piece movable in rotation about a pin fast with the casing.

What is claimed is:

1. An improved safety binding for a ski having a longitudinal plane of symmetry comprising a jaw having a rear end which is engagable with one end of the sole of a ski boot; a casing integrally extending in a forward direction from said jaw; support means connectible to said ski and providing two lateral support lines disposed respectively on either side of the longitudinal plane of symmetry of the ski; said jaw and casing defining a bore, said jaw having a front transverse face; said support means comprising a support member engaged in said bore and having a front transverse face and a rear transverse face opposed to the front transverse face of the jaw, the front transverse face of the jaw and the rear transverse face of the support member including projections and the other transverse face having recesses receiving said projections for defining said support lines to permit relative movement between said jaw and said support member, resilient means located in said bore for acting on the front transverse face of the support member and on said jaw to urge said projections into said recesses to cause the jaw to pivot on either line of support, the lines of support viewed along the longitudinal axis of the ski, as converging toward a point disposed above the ski whereby in a first direction of lateral movement of the jaw, the jaw will pivot about one line of support and in a second direction of lateral movement of the jaw, the jaw will pivot about a second line of support, said resilient means being further defined by a pressure member bearing upon the front transverse face of said support member and a spring engaging said pressure member and said casing; said improvement comprising: providing said support member on its front transverse face, with at least two lines of reaction converging downward towards the ski and having on its rear transverse face at least two lines of reaction converging upwards, whereby, as the jaw is distant from the central position, causing the line of support of said jaw and casing and the lines of reaction in response to the movement of said pressure member, to be respectively located on either side of the longitudinal plane of symmetry on the ski.

2. A safety binding according to claim 1, wherein each of the lines of reaction is parallel to the corresponding line of support which is opposite thereto with respect to the longitudinal plane of symmetry.

3. A safety binding according to claim 2, wherein the lines of reaction are symmetrical with respect to the longitudinal plane of symmetry of the binding.

4. A safety binding according to claim 3, wherein the front face of the fixed support member is in the form of an isosceles triangle with vertex facing downwardly and of which the two symmetrical sides, comprised respectively between the upper vertices of the triangle and the lower vertex, constitute fixed lines of reaction for the elastically urged member.

5. A safety binding according to claim 4, wherein the front face of the fixed support member is flat.

6. A safety binding according to claim 4, wherein the front face of the support member presents a recessed central part so that, in rest position, the elastically urged member is in contact with the fixed support member only along the two edges, forming lines of reaction.

7. A safety binding according to claim 1, wherein the fixed support member presents, on its front face, two lateral surfaces of reaction symmetrical with respect to the longitudinal plane of symmetry of the binding, each of these surfaces being generated by a straight line parallel to that of the lines of support which is located on the other side of the longitudinal plane of symmetry of the binding and which abuts on a curve.

8. A safety binding according to claim 1, wherein the front transverse face of the one-piece assembly constituted by the jaw and the casing of the binding and the rear transverse face of the support member present, on each side of the longitudinal plane of symmetry of the binding, two ribs and two grooves, respectively, so that a lateral release is effected in two stages, firstly by rotary pivoting of one of the ribs, nearest the plane of symmetry, in the corresponding groove, then by pivoting of the associated complementary rib, located outside with respect to the preceding one, in the corresponding groove.

* * * * *